US005727965A

United States Patent [19]

Yagi

[11] Patent Number: 5,727,965

[45] Date of Patent: Mar. 17, 1998

[54] BRANCH CONNECTOR APPARATUS

[76] Inventor: Kazuhiro Yagi, P.O. Box 33427, St. Paul, Minn. 55133-3427

[21] Appl. No.: 722,058

[22] PCT Filed: Sep. 25, 1996

[86] PCT No.: PCT/US96/15370

§ 371 Date: Sep. 25, 1996

§ 102(e) Date: Sep. 25, 1996

[30] Foreign Application Priority Data

Oct. 31, 1995 [JP] Japan ..... 7-283972

[51] Int. Cl.[6] ..... H01R 4/26

[52] U.S. Cl. ..... 439/402; 439/488

[58] Field of Search ..... 439/402, 417, 439/488, 213, 322

[56] References Cited

U.S. PATENT DOCUMENTS

| | | | |
|---|---|---|---|
| 3,573,713 | 4/1971 | Enright | 439/402 |
| 4,695,107 | 9/1987 | Leppert | 439/488 |
| 5,435,747 | 7/1995 | Frankx et al. | 439/488 |
| 5,520,549 | 5/1996 | Tanaka et al. | 439/402 |

*Primary Examiner*—J. J. Swann

*Attorney, Agent, or Firm*—Matthew B. McNutt

[57] ABSTRACT

It is an object of the invention to realize a branch connector apparatus in which a branch connecting operation can be correctly and quickly carried out in accordance with polarity without cutting a main conductor or removing an insulator of the main conductor or a branch conductor. The apparatus comprises a connector 13 and a housing 3 which is provided with a main conductor insertion hole in which a multi-core flat insulation sheath cable (main conductor) can be inserted, a branch conductor insertion hole in which an insulated wire (branch conductor) can be inserted, and a connector insertion hole. One of conductive contacts of the connector pierces the insulator of the main conductor to engage with the main conductor portion. The other conductive contact pierces the insulator of the branch conductor to engage with the branch conductor portion. The apparatus further includes a sheath cutter 11 which can cut only the sheath portion of the main conductor so as to expose the insulator of the main conductor, and a sheath cutter insertion hole 35 provided in the housing to guide the sheath cutter 11.

4 Claims, 13 Drawing Sheets

BRANCH CONNECTOR APPARATUS

TECHNICAL FIELD TO WHICH THE INVENTION BELONGS

The present invention relates to a branch connector apparatus which can be used in an electrical wiring operation.

PRIOR ART

For instance, in a domestic low-voltage wiring operation, a double-core flat cable with a vinyl insulator (referred to as a WF cable hereinafter), in which two conductors (corresponding to electric wires) insulated by insulators extend in parallel and are surrounded by a sheath (protection cover) in an oval shape in cross section is usually used as a main conductor.

The applicant of the present application has proposed an extremely rational and inexpensive connector apparatus in which a branch conductor can be branched from a main conductor, that is, the branch conductor can be connected to the main conductor, without cutting the main conductor (VVF cable) (Japanese Unexamined Patent Publication No. 7-130409). In this connector apparatus, no removal of the sheath and/or the insulator from the cable of the main conductor side or the branch conductor side is necessary, thus resulting in an increase in the operating efficiency.

In the connector apparatus mentioned above, it is impossible to identify the polarity of the two conductors of the main cable. Consequently, the branch conductor is twisted so as to meet the polarity of a terminal allotter after the branch conductor is connected. However, the twisting of the branch conductor is not desirable, and hence, need has risen to propose a connector in which the polarity of the main cable can be easily discriminated from the outside, so that the branch conductor can be correctly connected.

To this end, according to the present invention, an attempt has been made to improve the above mentioned apparatus, proposed by the applicant, by realizing a branch connector apparatus in which the sheath of the main conductor can be safely and easily removed; the polarity of the conductor can be judged in accordance with the color (white or black) of the insulator surrounding the conductor; and, the connection of the branch conductor can be appropriately carried out.

SUMMARY OF THE INVENTION

To achieve the object mentioned above, according to the present invention, there is provided a branch connector apparatus comprising, (a) a connector having two spaced conductive contacts and wedge-shaped portions;

(b) a housing having a main conductor inserting portion in which a main conductor including an insulated multi-core flat sheath cable is inserted, a branch conductor inserting portion in which an insulated branch conductor made of an insulated electrical wire is inserted, and a connector inserting portion in which a connector is inserted, wherein upon inserting the connector into the housing, one of said conductive contacts pierces an insulating portion of the main conductor to engage with a conductor portion of the main conductor, and the other conductive contact pierces an insulating portion of the branch conductor to engage with a corresponding conductor portion of the branch conductor, so that an electrical connection therebetween can be established, characterized in that;

provision is made of a sheath cutter which cuts only the sheath portion of the main conductor to expose the insulating portion of the main conductor, the housing is provided with a sheath cutter inserting portion in which the sheath cutter is guided to cut and remove the sheath.

Preferably, openings are provided in the sheath cutter and the housing so that the insulating portions which are exposed by cutting and removing the corresponding sheath portions can be viewed from the outside of the housing, upon insertion of the sheath cutter in the housing.

Preferably, an opening is provided in the housing so that the insulating portion which is exposed by cutting and removing the corresponding sheath portion can be viewed from the outside of the housing, upon insertion of the sheath cutter in the housing, and wherein at least the corresponding portion of the sheath cutter is at least semi-transparent.

The two conductive contacts of the connector are preferably provided with elongated slits which receive therein the conductor portions of the main conductor or the branch conductor, one of the elongated slits extending in parallel with the insertion direction of the connector, the other elongated slit being inclined at a predetermined angle with respect to the insertion direction of the connector.

EXPLANATION OF REFERENCE NUMERALS

| | |
|---|---|
| 1 | branch connector apparatus |
| 3 | housing |
| 5 | first half |
| 7 | second half |
| 9 | cover |
| 11, 51, 61, 71 | sheath cutter |
| 11a | cutter portion |
| 11b | opening |
| 13 | connector |
| 13a, 13b | conductive contact |
| 13c | cut-away portion |
| 21 | conductor member |
| 23 | wedge member |
| 35 | sheath cutter insertion hole |
| 37 | connector insertion hole |
| 41 | branch conductor (conductor portion) insertion hole |
| WM | main conductor |
| WS | branch conductor |
| OP | opening |

MODE FOR CARRYING OUT

An embodiment of the invention will be discussed below with reference to the drawings.

Figure 1:
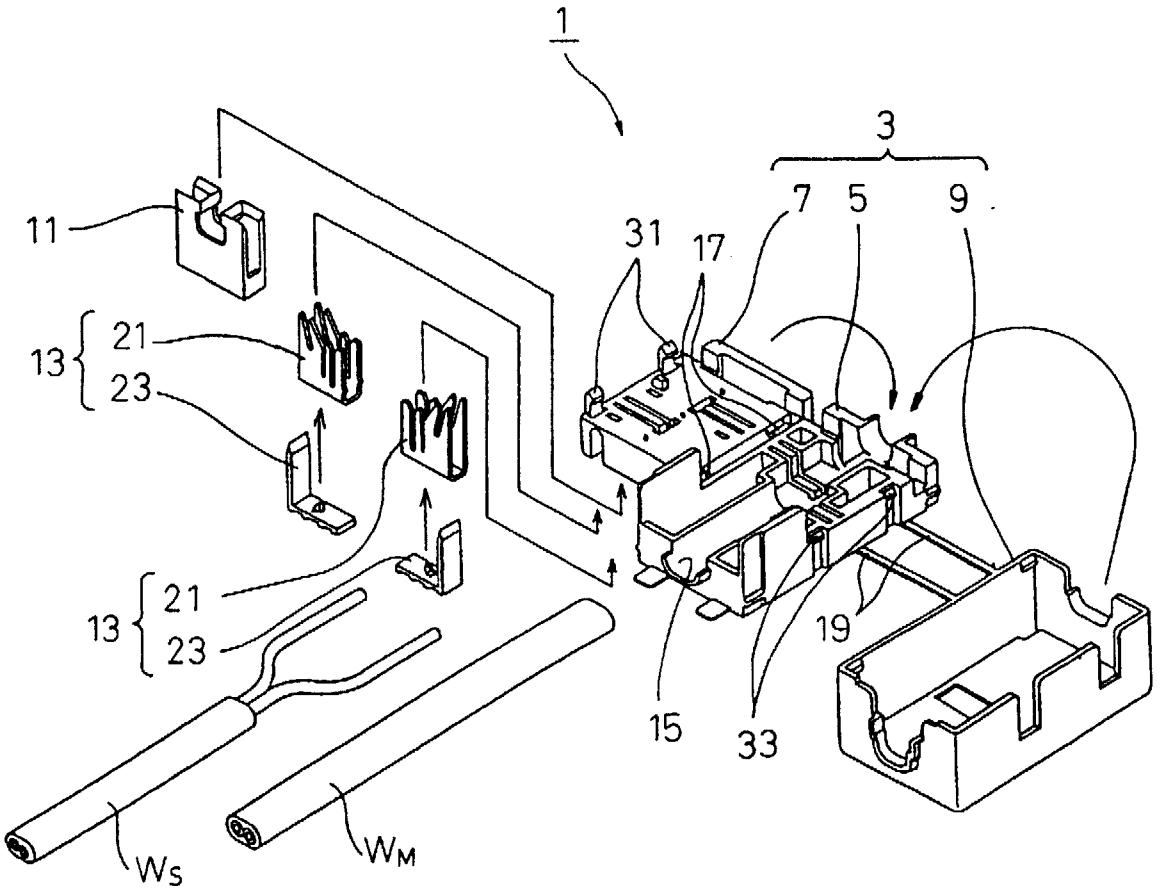
FIG. 1 is an exploded perspective view of a branch connector apparatus according to an embodiment of the present invention.

FIG. 1 shows an exploded perspective view of a branch connector apparatus (so-called joint box) 1 according to an embodiment of the present invention, wherein a main conductor WM and a branch conductor WS are set, each being made of a double-core flat sheath cable with a vinyl insulator (VVF cable; Vinyl Sheath Vinyl Insulated Flat Cable) for a domestic low-voltage wiring operation.

In FIG. 1, the branch connector apparatus 1 is comprised of a housing 3 which is basically comprised of three portions 5, 7, and 9 which will be discussed hereinafter, a sheath cutter 11 attached to the housing 3 to judge the polarity of the two conductor portions of the main conductor WM, and two connectors 13 which are adapted to electrically connect the corresponding conductor portions of the main conductor WM and the branch conductor WS.

The housing 3 is comprised of a first half 5 which is provided with an elongated groove 15 in which the main conductor WM is received and fitted, a second half 7 connected to one side surface of the first half 5 through a pair of bent portions (hinges) 17, and a cover 9 connected to the other side surface of the first half 5 through a pair of flexible elongated pieces (hinges) 19. The housing 3 is integrally made of an injection molding of an insulating non-rigid plastic such as PP (polypropylene) or nylon.

Figure 2A:
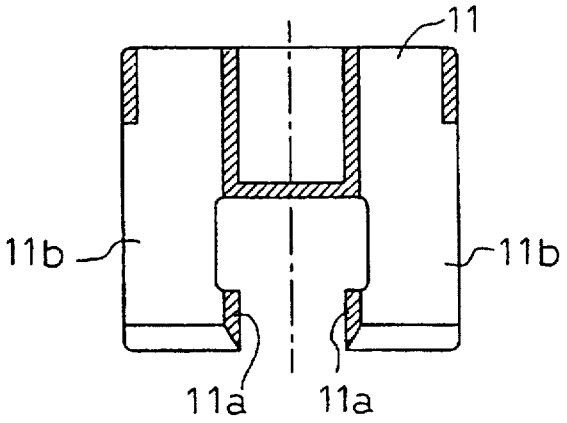
FIGS. 2 (*a*), (*b*), and (*c*) are a sectional front elevational view, a bottom view, and a side view of a sheath cutter, respectively.
Figure 2C:
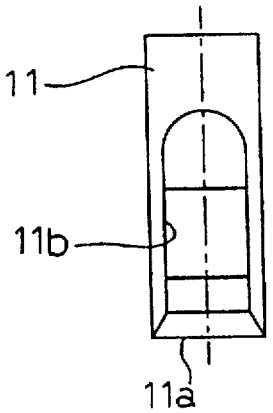
Figure 2B:
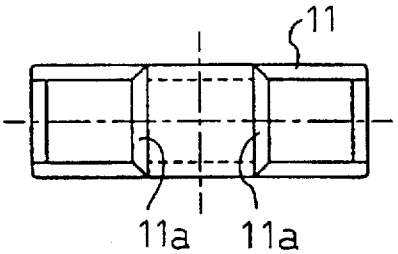
Figure 3:
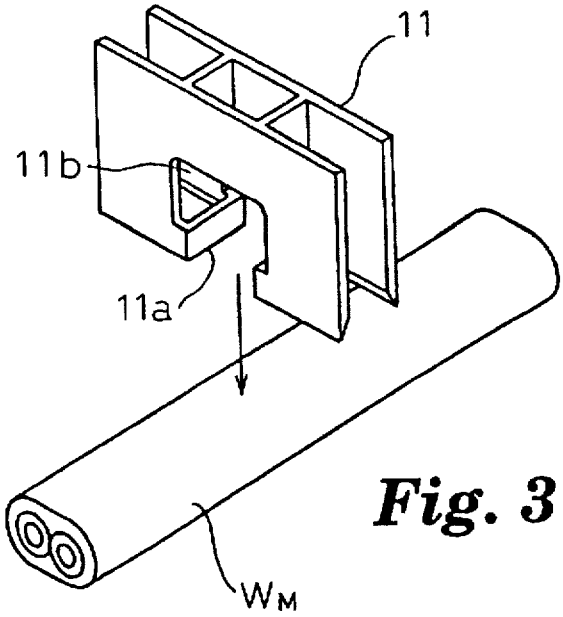
FIG. 3 is a perspective view of a sheath cutter before the sheath of a main conductor is removed.
Figure 4:
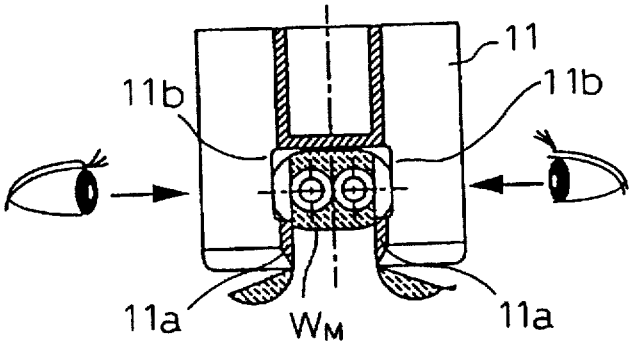
FIG. 4 is a sectional view of a sheath cutter and a main conductor upon removing a sheath.
Figure 5B:
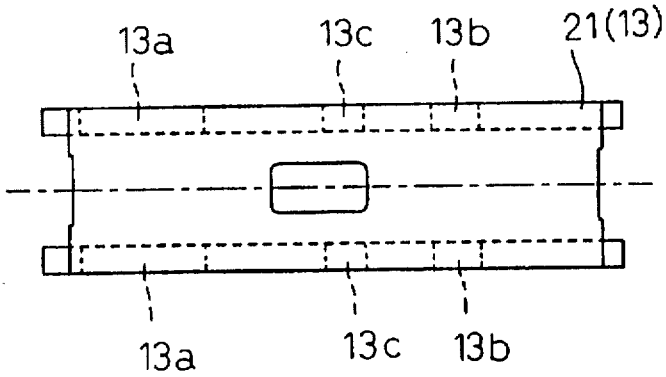
FIGS. 5 (*a*), (*b*), and (*c*) are a front elevational view, a plan view, and a side elevational view of a single conductive member which constitutes a connector, respectively.
Figure 5A:
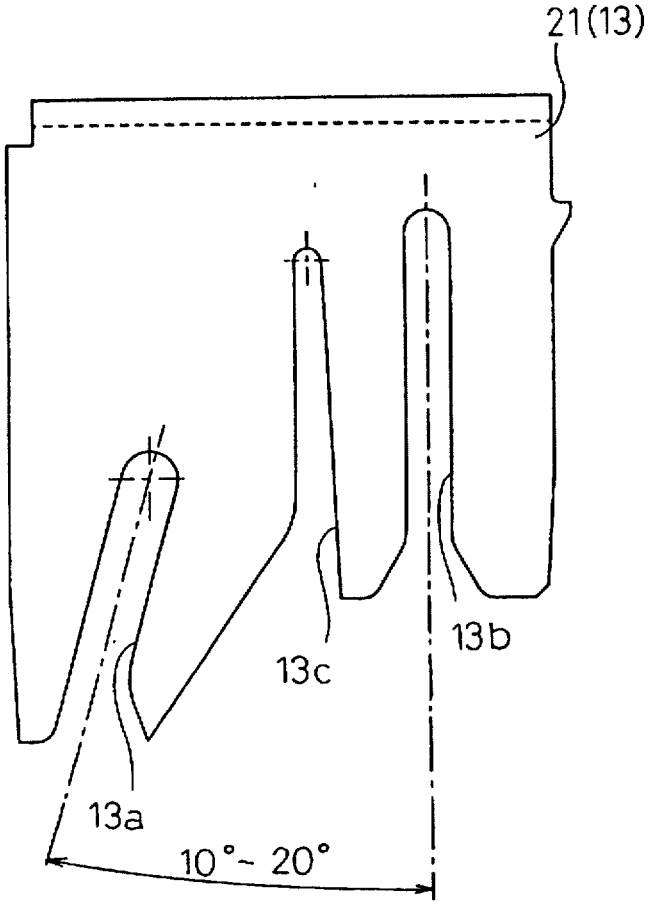
Figure 5C:
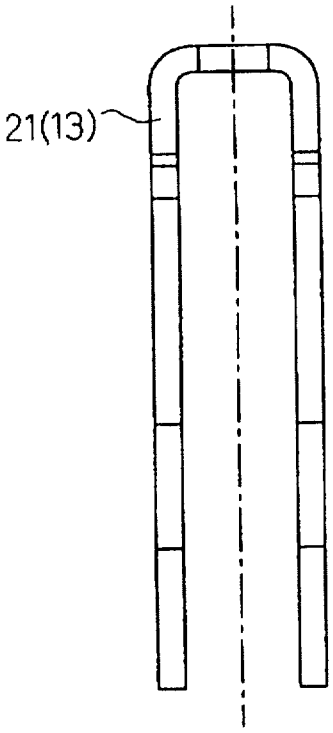

The sheath cutter 11 is shaped as shown in FIG. 2 and is provided with a pair of sharp cutter portions 11*a* which are spaced in parallel at a predetermined distance so as to cut and remove the sheath portions of the VVF cable only. The sheath cutter 11 is made of an injection mold of rigid synthetic resin having chemical resistance such as glass-reinforced polybutyleneterephthalate. When the sheath cutter 11 is inserted in the housing 3 from above to extend through the second half 7 which is folded onto the first half 5 at the bent portions 17 which serve as a hinge (FIG. 3), the opposite sides of the sheath portion of the main conductor WM are partly removed, so that the color (normally white or black) of the insulator thus exposed can be recognized from the outside of the housing. Thus, the polarity of the conductor portions of the main conductor WM can be judged (FIG. 4).

The connectors 13 are each comprised of a generally U-shaped conductor portion 21 made of a plate of copper or copper alloy, such as brass, phosphor bronze, beryllium copper, which is plated with solder or a silver, and a generally L-shaped insulating wedge member 23 which is mounted to the upper surface and one side surface of the conductor portion 21 and which is made of a rigid plastic or reinforced plastic, with a filler, such as PC (polycarbonate), etc. The conductor portions 21 are provided on the side surfaces thereof with two elongated slits (conductive contacts) 13*a*, 13*b* in which the cable conductors can be received. There are cut-away portions 13*c* between the conductive contacts 13*a*, 13*b*, which enable the conductive contacts to expand to some extent. One of the conductive contacts 13*a* and 13*b*, say, the conductive contact 13*a* is adapted to pierce the conductor portion of the main conductor WM and is inclined at approximately 10–20 degrees with respect to the other conductive contact 13*b*. The inclination angle is appropriately determined in accordance with the dimensional relationship of the sheaths of the main conductor WM and the branch conductor WS and the insulators. The wedge members 23 are adapted to guarantee the insulation between the conductor portions when it is inserted between the adjacent conductor portions of the main conductor WM (VVF cable). The wedge members 23 are formed with wedge-shaped ends. When the connectors 13 are mounted to the housing 3 similarly to the sheath cutter 11, the oblique conductor contact 13*a* pierces the insulating portion of the main conductor WM (sheath and insulator) and thrusts into one conductor portion of the main conductor to come into and engage therewith. The other conductive contact 13*b* pierces the insulating portion (insulator) of the branch conductor WS and thrusts into the branch conductor to come into contact and engage therewith. Thus, an electrical connection can be established.

The branch conductor wiring operation using the apparatus 1 of the present invention will be briefly discussed below referring to FIGS. 6 through 10.

Figure 6:
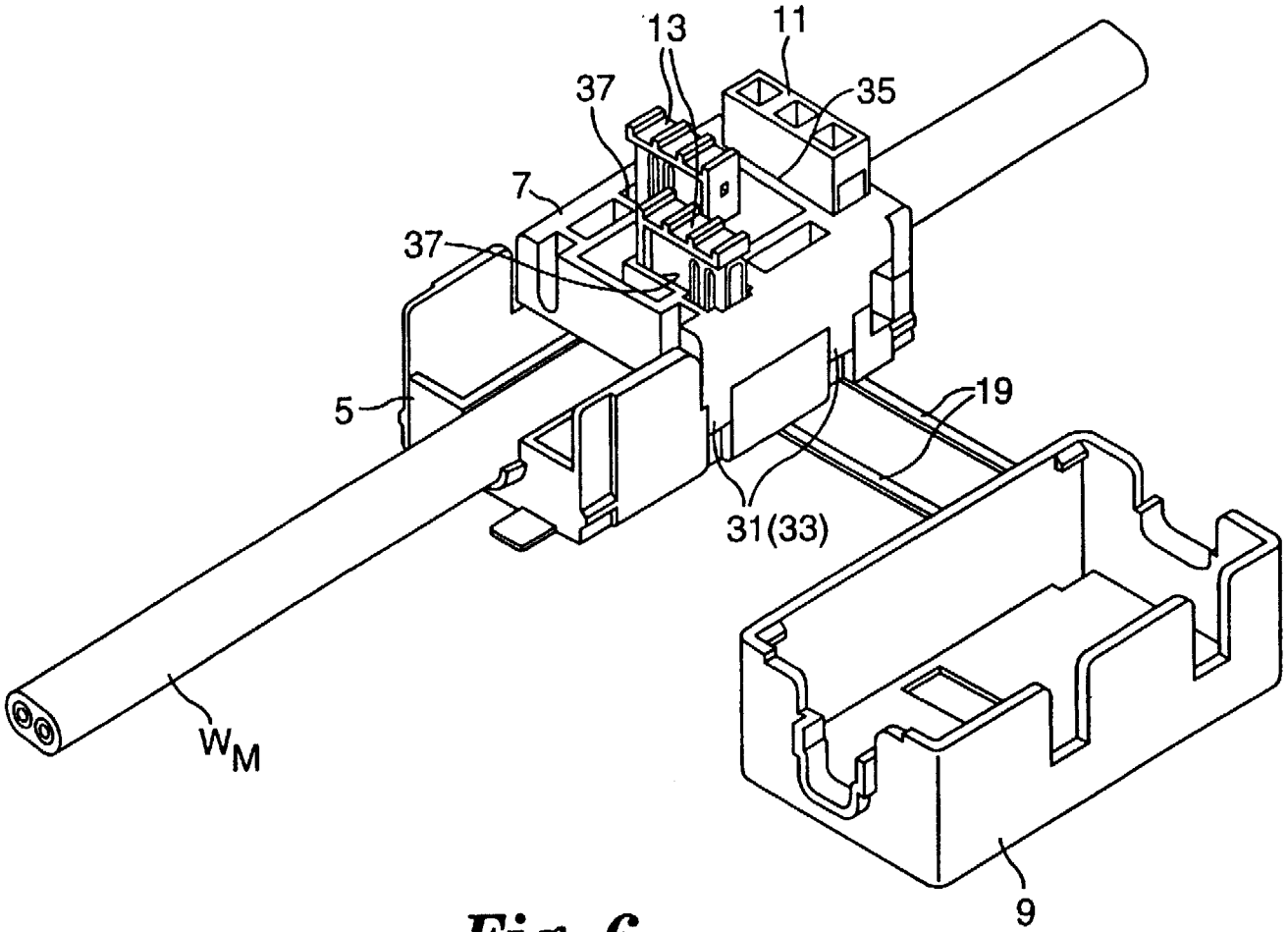
FIG. 6 is a perspective view of first and second halves that hold therebetween a main conductor.

As can be seen in FIG. 6, after the main conductor WM is mounted to the first half 5, the second half 7 is folded onto the first half 5 to hold the main conductor WM therebetween in a sandwich state. Consequently, the hook portions 31 of the second half 7 are engaged by the engaging portions 33 of the first half 5, so that the sandwich state can be held. Note that the second half 7 is provided with a sheath cutter insertion hole 35 and connector insertion holes 37, in which the sheath cutter 11 and the connectors 13 are loosely inserted and provisionally secured by the frictional force, etc., in advance for the purpose of facilitating the subsequent operations.

Figure 7:
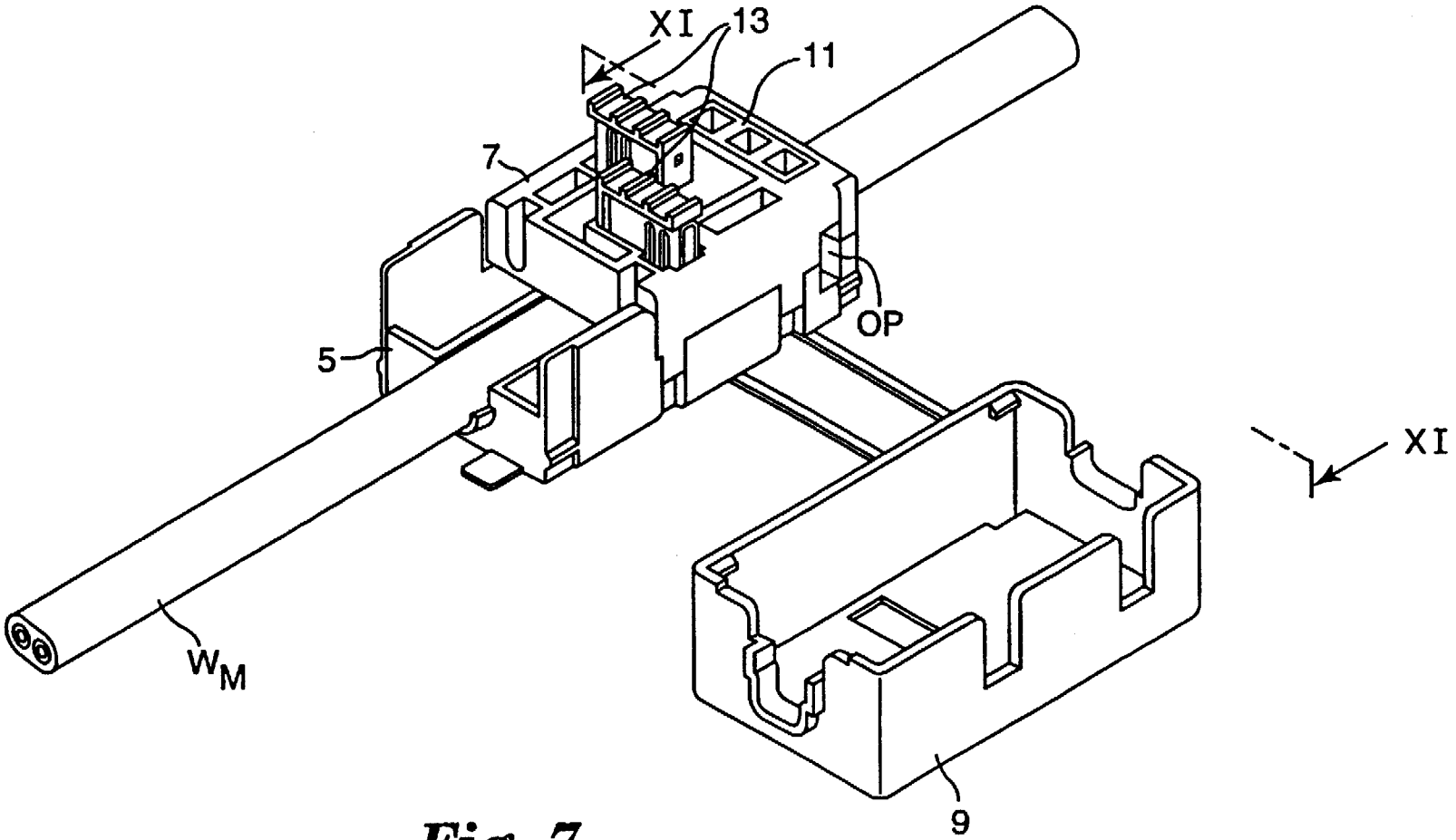
FIG. 7 is a perspective view of a housing in which a sheath cutter is pressed.
Figure 11:
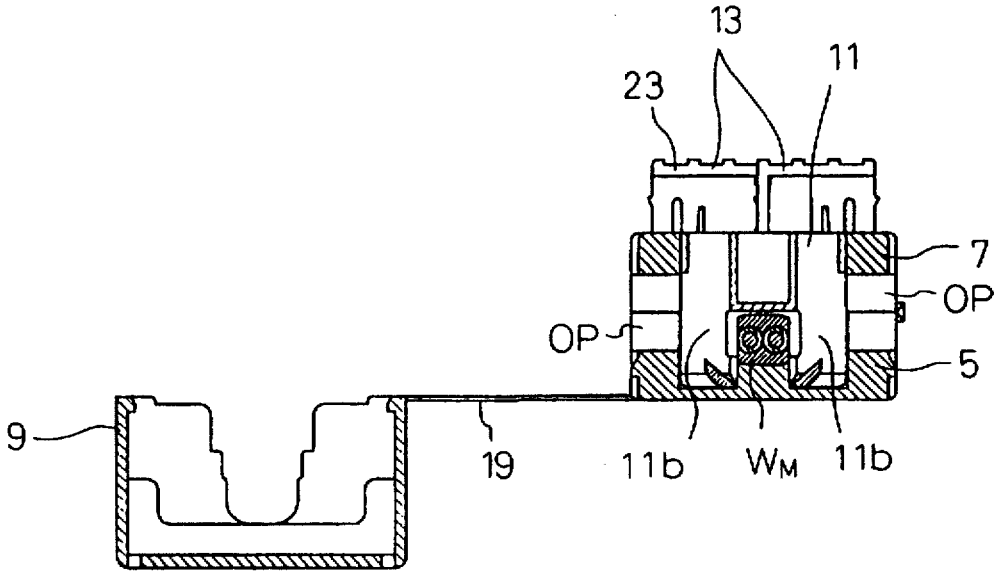
FIG. 11 is a sectional view taken along the line XI—XI in FIG. 7.

Thereafter, as shown in FIGS. 7 and 11, the sheath cutter 11 is completely pressed into the housing using an operator's hand or a special tool (not shown), such as cutting pliers. Consequently, the sheath portions on the opposite sides of the main conductor WM are only cut and removed by the cutting portions 11*a* of the sheath cutter 11, so that the color (white or black) of the insulator of the main conductor can be visually confirmed through the openings OP of the housing (first and second halves 5 and 7) and the openings 11*b* of the sheath cutter 11. Moreover, when the sheath cutter 11 thrusts into the main conductor WM, the housing 3 and the main conductor WM are relatively immovably held.

Figure 8:
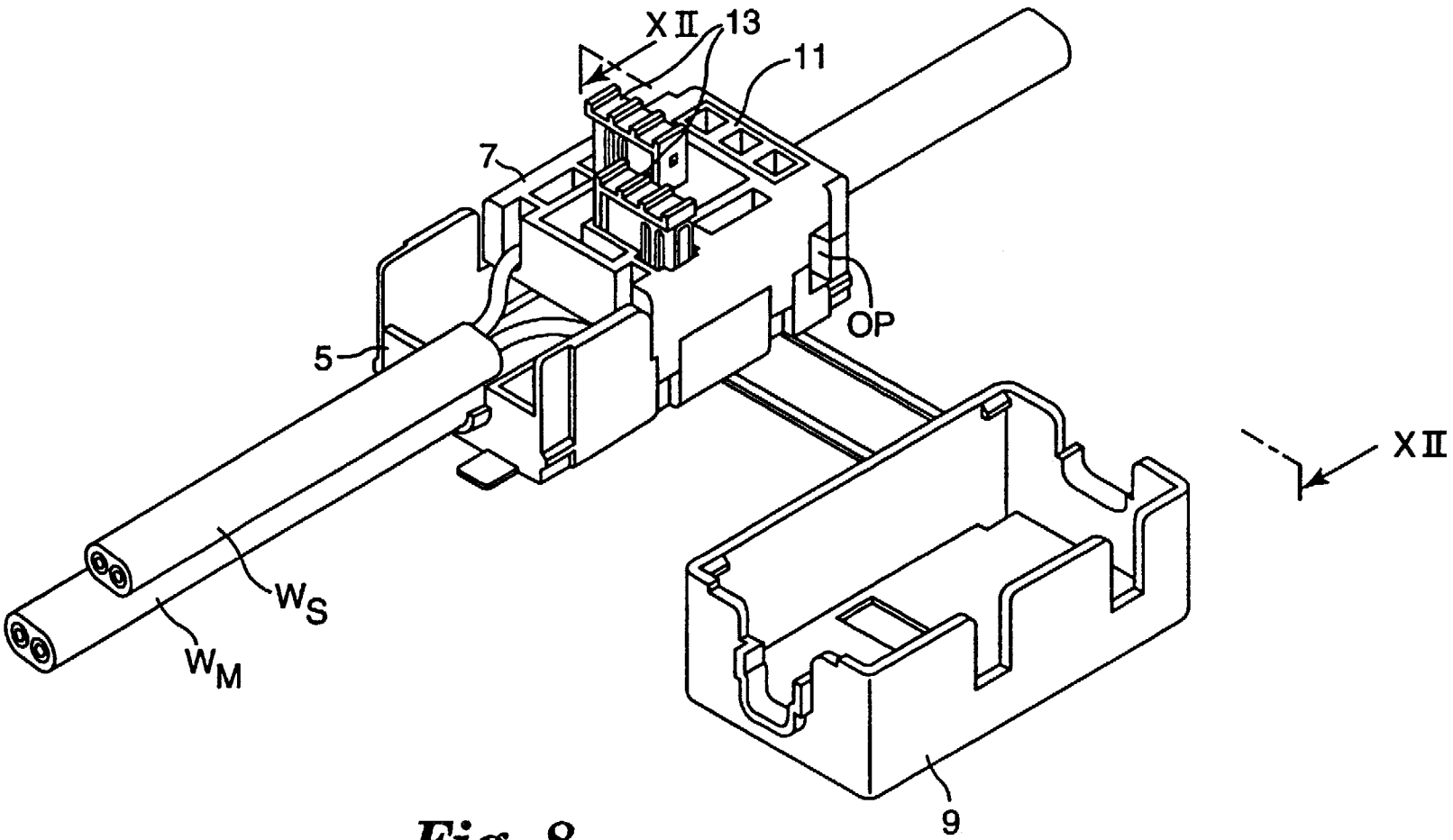
FIG. 8 is a perspective view of a housing in which a branch conductor is inserted.
Figure 12:
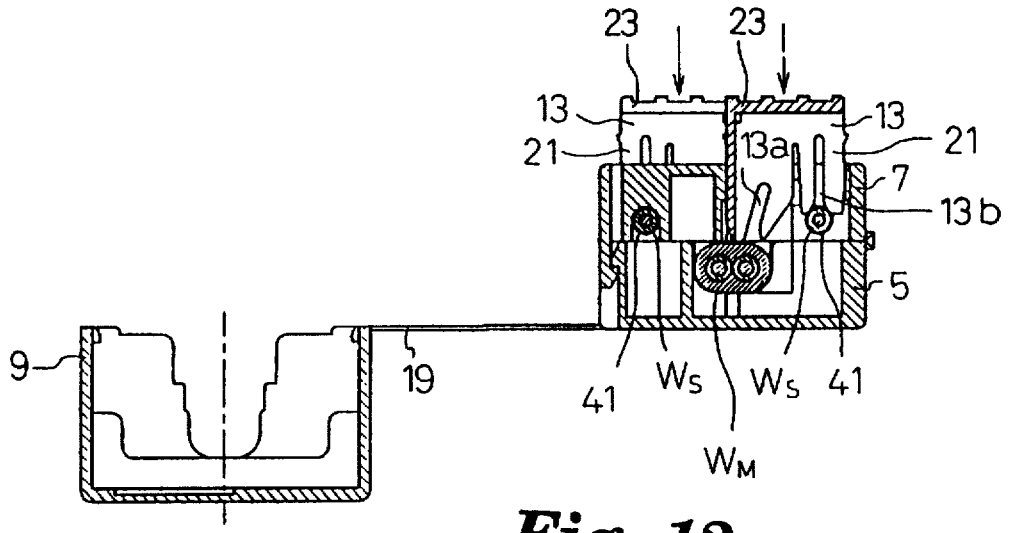
FIG. 12 is a sectional view taken along the line XII—XII in FIG. 8.

Thereafter, as shown in FIGS. 8 and 12, the sheath of the branch conductor WS at the front end thereof is removed by a predetermined length (e.g., 50 mm) to produce two conductor portions which are covered by the insulator only. The conductive portions are inserted in the two branch conductor insertion holes 41 formed in the second half 7 to extend parallel with the main conductor WM, so that the polarities of the two conductors correspond to those of the conductors of the main conductor WM that have been identified in the previous judging operation.

Figure 9:
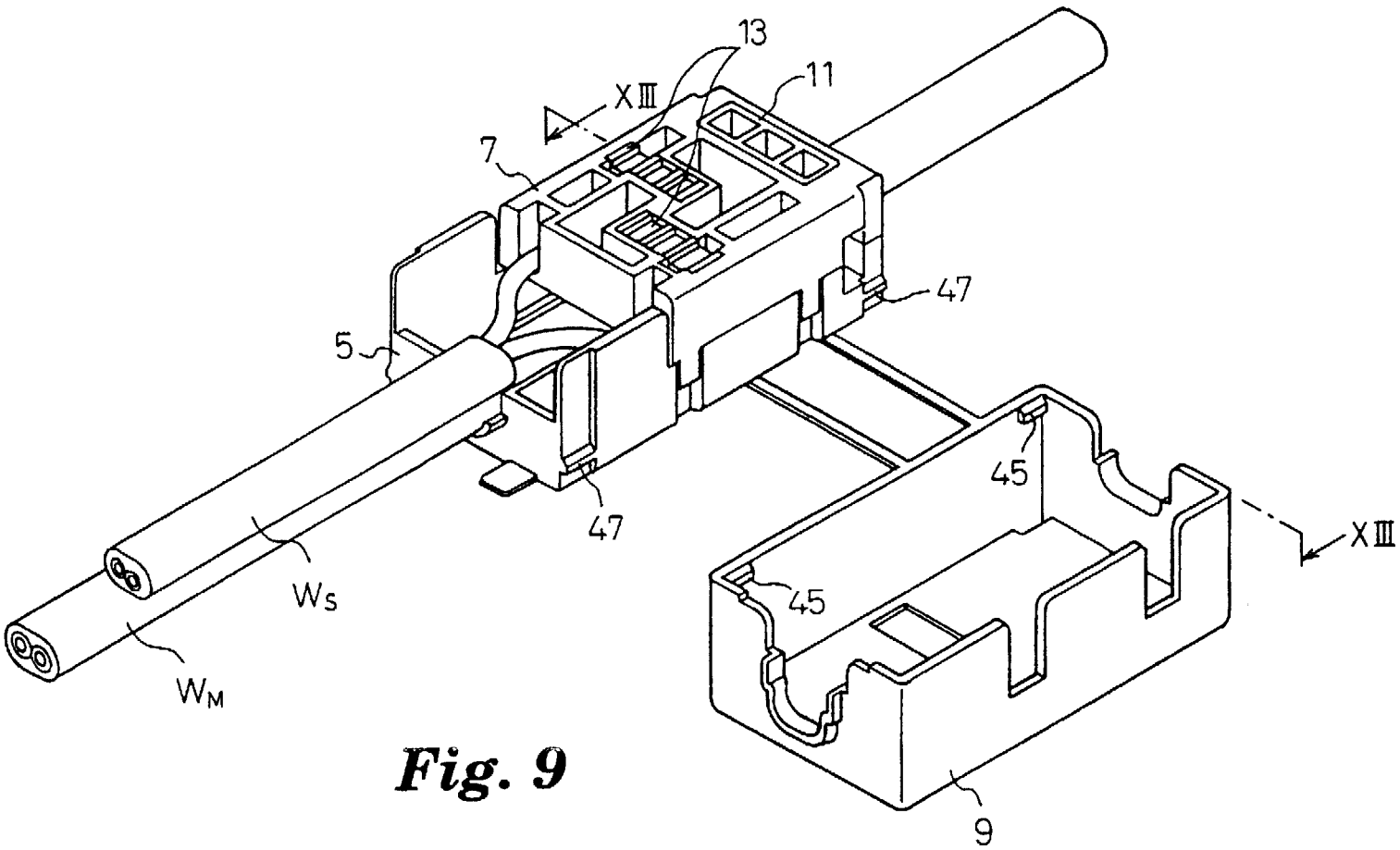
FIG. 9 is a perspective view of a housing in which a connector is forced.
Figure 13:
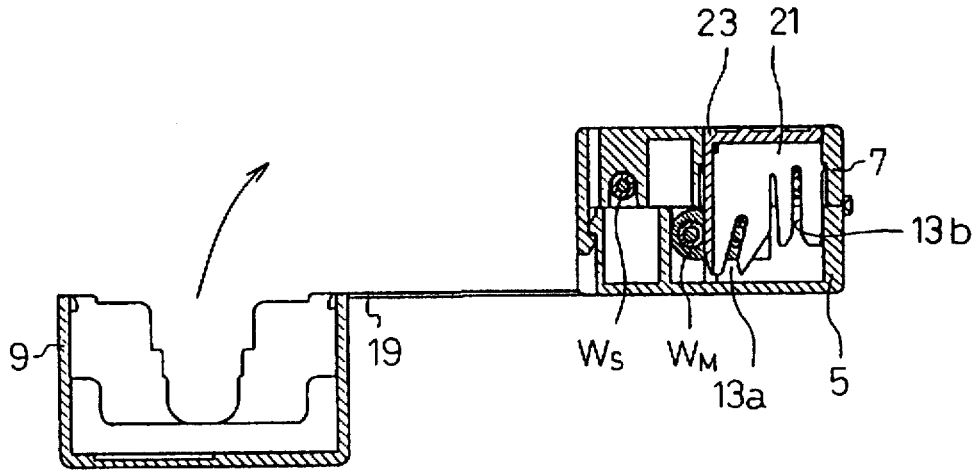
FIG. 13 is a sectional view taken along the line XIII—XIII in FIG. 9.

After that, as may be seen in FIGS. 9 and 13, the two connectors 13 are pressed into the housing, similarly to the sheath cutter 11. As a result, the sharp edges of the wedge members 23 thrust into the conductor portions of the main conductor WM, so that the conductive contact 13*a* of the conductor portion 21 on the side of the wedge member pierces the sheath and insulator of the main conductor WM to come into contact and engage with the main conductor portion. The other conductive contact 13*b* pierces the insulator of the branch conductor WS and comes into contact and engages with the branch conductor portion. Namely, one (core) of the conductor portions of the main conductor WM is electrically connected to one (core) of the conductor portions of the branch conductor WS, and the other conductor portion (core) of the main conductor WM is electrically connected to the other conductor portion (core) of the branch conductor WS, through the two connectors 13, respectively.

Figure 10:
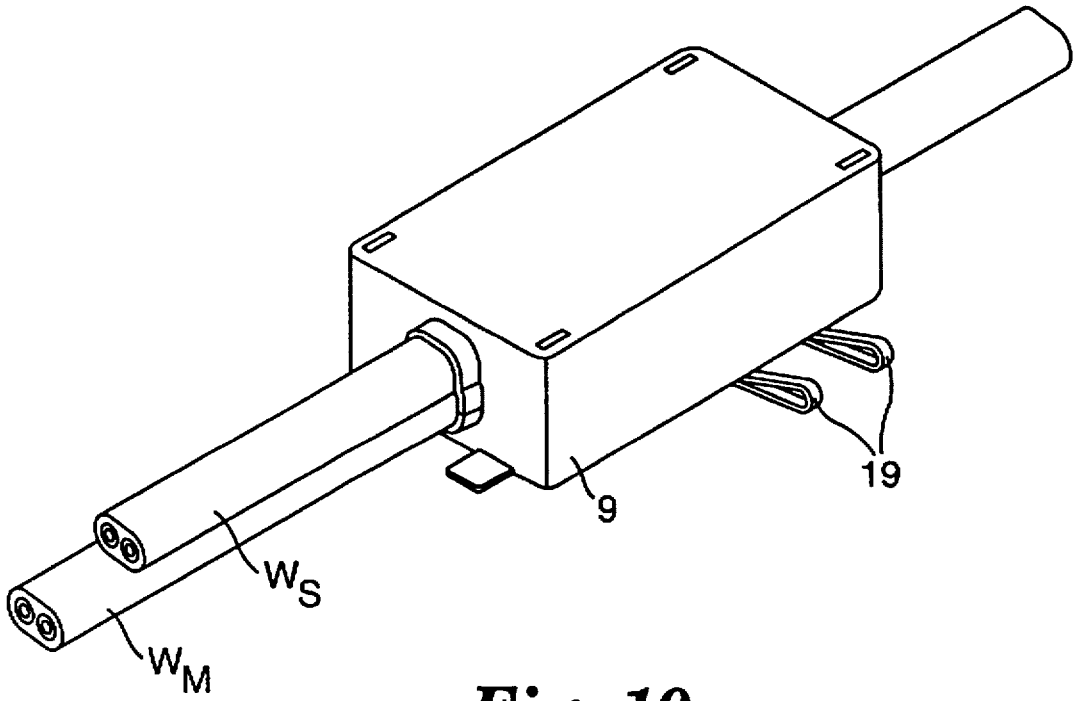
FIG. 10 is a perspective view of a housing covered by a cover.

Finally, as shown in FIG. 10, the cover 9 is folded at the flexible elongated pieces (hinges) 19 and put on the second half 7 and the first half 5. Consequently, the hooks 45 provided at the four inner corners of the cover 9 are engaged by the corresponding engaging portions 47 of the first half 5. Thus, the cover 9 is stably held in the engaged position.

As can be understood from the above discussion, according to the illustrated embodiment, the branching operation of the branch conductor WS from the main conductor WM can be extremely easily and quickly carried out without cutting the main conductor WM (VVF cable). Moreover, since the sheath portion can be safely and certainly removed by the sheath cutter, the polarity of the conductor portions of the main conductor WM can be easily detected, and hence, an appropriate branching operation can be performed. In addition to the foregoing, since the conductive contacts are inclined, the force necessary to press the sheath cutter therein can be reduced, thus resulting in an enhanced durability. Furthermore, the upper surfaces of the connectors are finally covered and insulated by the cover for the purpose of security.

Figure 14:
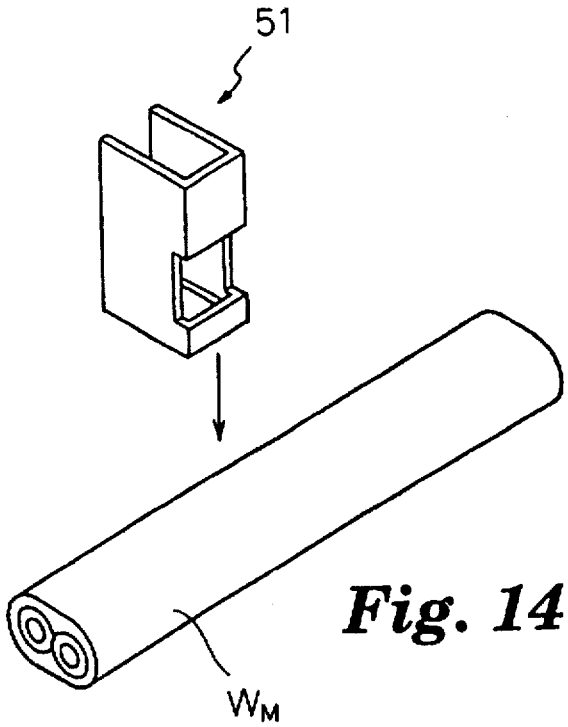
FIG. 14 is a perspective view of a sheath cutter having only one cutter portion.
Figure 15:
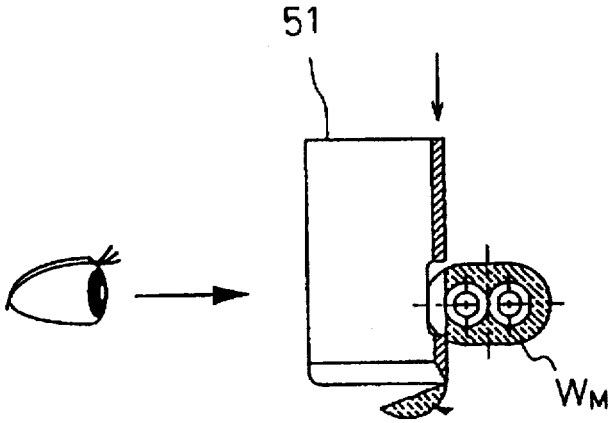
FIG. 15 is a sectional view of a sheath cutter shown in FIG. 14, upon cutting and removing a sheath.

Note that the polarity of the conductor portions of the main conductor WM can be judged as soon as the sheath portion of at least one side thereof is cut and removed, and hence, it is possible to use a sheath cutter 51 which corresponds to a half of the sheath cutter mentioned above, as shown in FIG. 14. In this alternative, the housing is provided with a sheath cutter insertion hole (not shown) corresponding to the sheath cutter 51.

Figure 16:
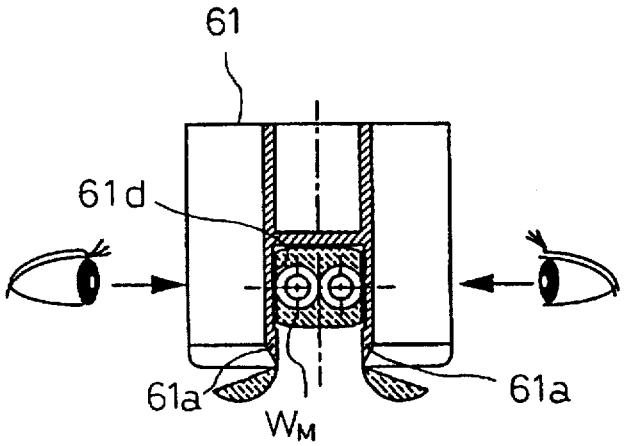
FIG. 16 is a sectional view of a sheath cutter having no opening.
Figure 17:
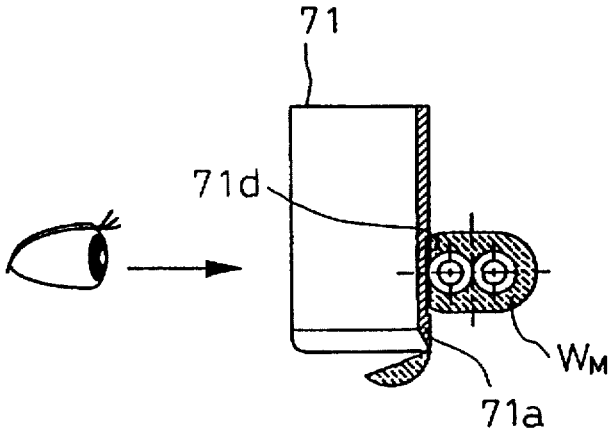
FIG. 17 is a sectional view of another embodiment of a sheath cutter having no opening.

If the sheath cutter itself is made of a transparent or a semi-transparent material transparent amorphous synthetic resin), it is not necessary to provide the openings 11*b* in the sheath cutter 11 to judge the polarity. Consequently, a sheath cutter 61 or 71 as shown in FIG. 16 or 17 can be used. In case of the sheath cutter 61 or 71 having no opening, the sheath cutter is preferably provided, on the rear portion of the cutter portion 61*a* or 71*a*, with a recessed portion 61*d* or 71*d* which receives the cut sheath piece to thereby ensure that the inside (insulators) can be viewed.

Furthermore, the application of the present invention is not limited to a double-core vinyl sheath vinyl insulated flat cable (VVF cable) as discussed above. The present invention can be generally applied to multi-core cables made of various materials. The two connector insertion holes provided in the housing can be arranged along a line perpendicular to the length of the housing (not shown).

As can be seen from the foregoing, according to the present invention, the branch connecting operation can be precisely and quickly effected in accordance with the polarity, without cutting the main conductor or removing the insulators of the main conductor and the branch conductor, thus resulting in a dramatically enhanced operating efficiency and reliability.

I claim:

1. A branch connector apparatus having two spaced conductive contacts and wedge-shaped portions;

a housing having a main conductor inserting portion in which a main conductor including an insulated multi-core flat sheath cable is inserted, a branch conductor inserting portion in which an insulated branch conductor made of an insulated electrical wire is inserted, and a connector inserting portion in which a connector is inserted, wherein upon inserting the connector into the housing, one of said conductive contacts pierces an insulating portion of the main conductor to engage with a conductor portion of the main conductor, and the other conductive contact pierces an insulating portion of the branch conductor to engage with a corresponding conductor portion of the branch conductor, so that an electrical connection therebetween can be established, characterized in that;

provision is made of a sheath cutter which cuts only the sheath portion of the main conductor to expose the insulating portion of the main conductor, the housing is provided with a sheath cutter inserting portion in which the sheath cutter is guided to cut and remove the sheath.

2. A branch connector apparatus according to claim 1, wherein openings are provided in the sheath cutter and the housing so that the insulating portions which are exposed by cutting and removing the corresponding sheath portions can be viewed from the outside of the housing, upon insertion of the sheath cutter in the housing.

3. A branch connector apparatus according to claim 1, wherein an opening is provided in the housing so that the insulating portion which is exposed by cutting and removing the corresponding sheath portion can be viewed from the outside of the housing, upon insertion of the sheath cutter in the housing, and wherein at least the corresponding portion of the sheath cutter is at least semi-transparent.

4. A branch connector apparatus according to claim 1, wherein said two conductive contacts of the connector are provided with elongated slits which receive therein the conductor portions of the main conductor or the branch conductor, one of the elongated slits extending in parallel with the insertion direction of the connector, the other elongated slit being inclined at a predetermined angle with respect to the insertion direction of the connector.

* * * * *

UNITED STATES PATENT AND TRADEMARK OFFICE

Certificate

Patent No. 5,727,965 Patented: March 17, 1998

On petition requesting issuance of a certificate for correction of inventorship pursuant to 35 U.S.C. 256, it has been found that the above-identified patent, through error and without deceptive intent, improperly sets forth the inventorship.

Accordingly, it is hereby certified that the correct inventorship of this patent is: Kazuhiro Yagi and Elmont E. Hollingsworth.

Signed and Sealed this Nineteenth Day of September, 2000.

BRIAN W. BROWN
*Special Program Examiner*
Technology Center 2800